United States Patent [19]

Brandes

[11] Patent Number: 4,820,184

[45] Date of Patent: Apr. 11, 1989

[54] ELECTRICAL CONNECTOR RETAINING RATCHET

[75] Inventor: Henning F. Brandes, Yucaipa, Calif.

[73] Assignee: Interconnection Products Incorporated, Santa Ana, Calif.

[21] Appl. No.: 103,967

[22] Filed: Oct. 5, 1987

[51] Int. Cl.[4] ..... H01R 13/62

[52] U.S. Cl. ..... 439/321; 439/312; 29/469

[58] Field of Search ..... 439/312–323; 285/82; 29/434, 469

[56] References Cited

U.S. PATENT DOCUMENTS

| | | | |
|---|---|---|---|
| 1,173,998 | 2/1916 | Depew | 217/93 |
| 3,343,852 | 9/1967 | Blight et al. | 285/82 |
| 3,405,432 | 10/1968 | Scaravelli | 29/274 R |
| 3,570,325 | 3/1971 | Kroll et al. | 74/527 |
| 3,594,700 | 7/1971 | Nava et al. | 439/321 |
| 3,601,764 | 8/1971 | Cameron | 439/315 |
| 4,165,910 | 8/1979 | Anderson | 439/318 |
| 4,239,314 | 12/1980 | Anderson et al. | 339/89 |
| 4,268,103 | 5/1981 | Schildkraut et al. | 439/321 |
| 4,407,529 | 10/1983 | Holman | 285/82 |
| 4,588,245 | 5/1986 | Schwartz et al. | 439/312 |

FOREIGN PATENT DOCUMENTS

| | | | |
|---|---|---|---|
| 2002273 | 10/1969 | France | 439/321 |

*Primary Examiner*—Eugene F. Desmond

*Attorney, Agent, or Firm*—Watts, Hoffmann, Fisher & Heinke Co.

[57] ABSTRACT

A ratchet apparatus is disclosed for preventing inadvertent decoupling of two couplable members, such as plug and receptacle parts of an electrical connection apparatus. The plug has a coupling nut mounted on it, the coupling nut having threads for engaging the receptacle member and drawing the plug and receptacle together in response to relative rotation between the coupling nut and receptacle. An elongated ratchet strip bearing ratchet teeth is disposed about the outer circumference of the plug member. The coupling nut carries ratchet pins distributed generally about its inside diameter for engagement against the ratchet strip teeth. The coupling nut also carries a spiral wound ratchet retaining ring about the outside of the ratchet pins for exerting and maintaining radially inward force on the ratchet pins to maintain resilient engagement of the pins with the teeth of the ratchet strip.

21 Claims, 2 Drawing Sheets

ELECTRICAL CONNECTOR RETAINING RATCHET

TECHNICAL FIELD

This invention relates generally to apparatus for inhibiting inadvertent decoupling of two couplable members, and more specifically to ratchet apparatus for inhibiting inadvertent disengagement of thread-coupled plug and receptacle members of an electrical connection apparatus.

BACKGROUND ART

One form of electrical connector includes a plug and a receptacle. Each of the plug and receptacle portions includes an insulative insert carrying one or more electrical contacts. When the plug and receptacle are mated, the electrical contacts are engaged to complete an electrical circuit.

Connector parts, such as plugs and receptacles, can advantageously be made of a large variety of materials. Metal bodies have been used, but, because of their tendency to corrosion, it is often necessary to add expensive and wear-sensitive corrosion-inhibiting plating. More recently, the corrosion problem has been overcome by the use of composite or plastic materials for plug and receptacle bodies.

Both bayonet and threaded coupling means have been used for facilitating maintenance of the engagement between the plug and the receptacle. Where a threaded engagement means is used, the plug comprises a cylindrical plug body member. The receptacle, generally tubular in shape, has a matching set of threads which are inscribed about its outer diameter.

One problem with plug/receptacle electrical connectors is their susceptibility to inadvertent disconnection or decoupling as a result of shock or vibration. While threaded couplings have generally been superior to bayonet couplings in reducing inadvertent vibration-caused disconnection, threaded couplings can, over time, also loosen or become completely disconnected in the presence of shock or vibration. Such considerations are of considerable importance in situations in and near heavy machinery, vehicles, planes and ships, such as encountered in military applications.

Several types of detent mechanisms have been provided in order to inhibit inadvertent decoupling of electrical connectors due to shock or vibration. These devices, however, have been relatively complicated, required a large number of separate components and are often disposed inside the connector bodies, requiring intricate assembly operations.

In order to simplify construction of detent structures for resisting inadvertent decoupling, one technique has been to machine, or "broach" ratchet parts, such as teeth, about interior surfaces of plug or receptacle bodies, thus arriving at a structure wherein the ratchet or detent teeth are integral with the connector part itself. The use of composite parts, or plated metal parts, however, does not lend itself well to this manufacturing technique, which is itself complex and intricate. Composite materials, for example, do not possess sufficient hardness and resistance to mechanical wear and abrasion to permit the integral formation therein of detent parts such as teeth, leaf springs and the like. The alternative is that, where composite materials are used for connector part bodies it is not usually practical to form detent teeth or other parts integrally with the connector bodies. In such instances, it becomes necessary to assemble such detent parts of other, harder materials within the connector structure itself.

Where threaded electrical connectors are involved, a typical requirement is that the coupling, and its associated detent, or decoupling inhibiting mechanism, be capable of withstanding at least 500 couple/uncouple cycles. Thus, while the structure must be capable of resisting vibratory or shock forces tending to unscrew the connector parts, it must not entirely prevent such releasing movement either.

It is a general object of the present invention to provide a ratchet structure for inhibiting inadvertent disconnection between connector parts without the need to broach for machine ratchet teeth integrally to connector body parts, and to provide such ratchet structure which can be used in connector parts made from virtually any material or composite while maintaining improved ratchet force and wear characteristics.

DISCLOSURE OF INVENTION

The disadvantages of the prior art are reduced or eliminated by the use of an apparatus and method for inhibiting inadvertent decoupling between first and second members having primary means for facilitating coupling and decoupling between them. The apparatus includes a tooth bearing member different and separate from the first member but disposed on a surface of the first member to generally assume a configuration of that surface. The apparatus also includes structure for engaging the tooth bearing member, this engaging structure not being fixed to the first member and being couplable to the second member.

In accordance with a more specific embodiment, the apparatus includes structure for applying force to the tooth bearing member for resiliently urging the tooth engaging structure into engagement with the teeth of the tooth bearing member.

More specifically, the first member comprises an electrical connector plug which defines a generally cylindrical shape and an outer circumference, with the tooth bearing member being disposed upon the outer circumference. In this embodiment, the second member comprises an electrical receptacle. The apparatus further includes a coupling nut for effecting the coupling between the plug and receptacle, the coupling nut also including means for supporting the tooth engaging structure.

More specifically, the tooth bearing member is a ratchet strip made of flexible material and defining on its surface an array of ratchet teeth. The tooth engaging structure, mounting on the coupling nut, includes a number of ratchet pins and a ratchet pin retaining ring surrounding the pins and engaging them to resiliently force the pins into engagement with the teeth of the ratchet.

This invention will be understood more completely by reference to the following detailed description, and to the drawings.

BEST MODE FOR CARRYING OUT INVENTION

Figure 1:
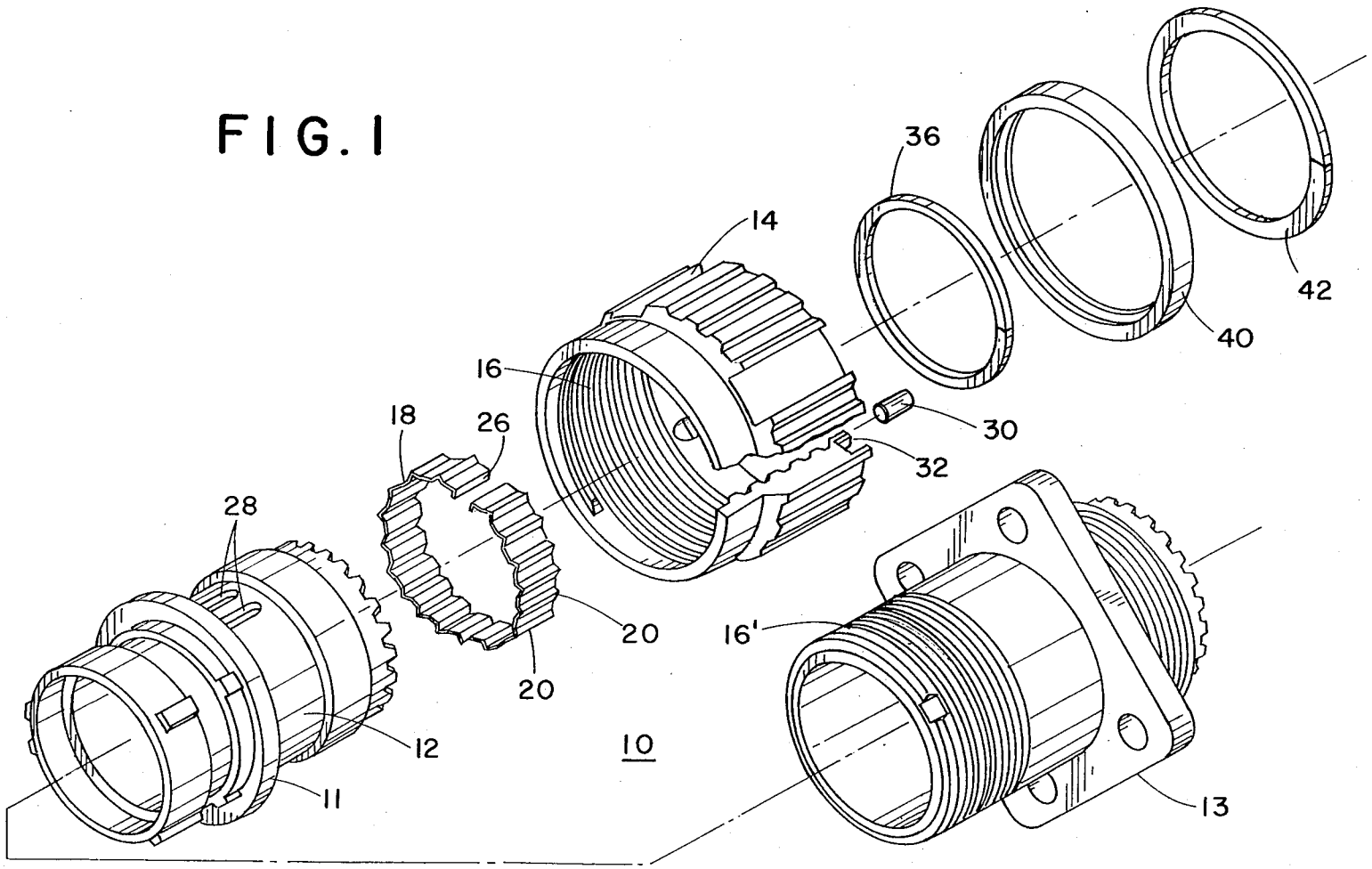
FIG. 1 is an exploded perspective view illustrating a preferred embodiment of the present invention.

FIG. 1 illustrates, in perspective, an exploded view of a set of parts making up an electrical connector apparatus 10 for use in coupling together electrically conductive contacts and leads. Major portions of the electrical connector apparatus include a plug member 12, a known receptacle member 13 and a coupling nut 14. The plug member 12 has an outside diameter sized to enable the plug member to fit axially within the coupling nut 14.

The coupling nut 14 is fitted coaxially over the plug 12. A shoulder 11 elevated from the outside diameter of the plug 12 engages with a corresponding shoulder 15 on the inner surface of the coupling nut 14 to prevent axial s of the coupling nut 14 from the plug 12 in a left hand direction as shown in FIG. 1.

A washer/cover structure 40, secured in the right hand end of the coupling nut 14 by a retaining ring 42, prevents movement of the coupling nut axially with respect to the plug in a direction toward the right relative to the plug, as shown in FIG. 1.

The coupling nut 14, however, is free to rotate about its axis with respect to the plug 12 independently of any rotation or other movement of the plug 12. A set of threads 16 are defined on the inner diameter of the coupling nut 14 and engage a corresponding set of threads 16' on the outer diameter of the receptacle 13.

It can be seen from the foregoing disclosure that, when the threads 16' of the receptacle 13 are engaged with the threads 16 on the interior of the coupling nut, and the coupling nut is rotated in a clockwise direction with respect to the receptacle 13, the shoulders 11, 15 of the plug and coupling nut will be caused to bear on one another, and the receptacle 13 will be drawn into close engagement with the right hand end of the plug 12 as shown in FIG. 1.

Counterclockwise rotation of the coupling nut with respect to the receptacle reverses the process and uncouples the coupling nut, and hence the plug, from the receptacle.

It should be understood that the drawings in this document do not purport to fully illustrate the actual electrically conductive leads, terminals and associated insulative parts used in conjunction with the electrical connector apparatus 10. Provision of such electrically conductive apparatus is within the ordinary skill in the art. For those not intimately conversant with this art, however, an electrical connector apparatus having such electrically conductive and mechanical parts is identified as a Mil Spec part No. D38999/26FA35PN.

Figure 2:
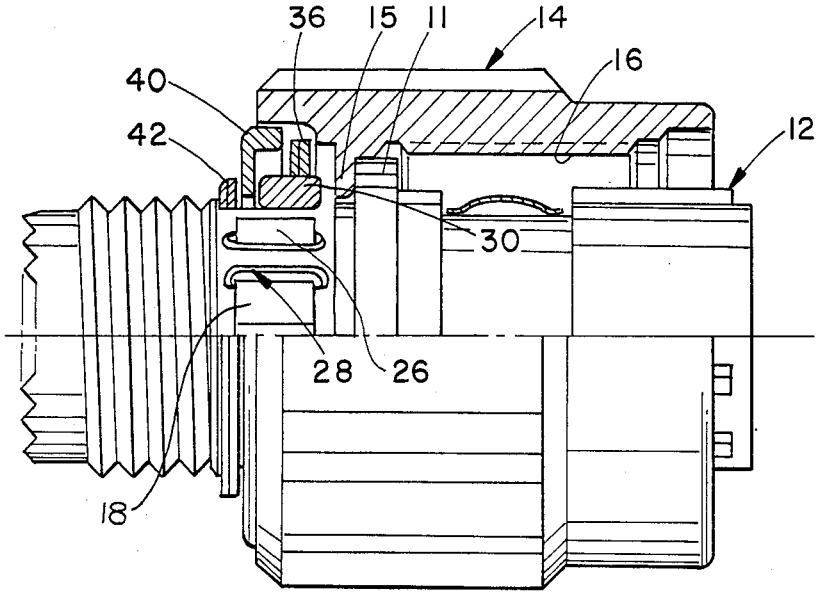
FIG. 2 is an elevational view, taken in cross-section, of the embodiment of the exploded view of FIG. 1 in its assembled configuration.
Figure 3:
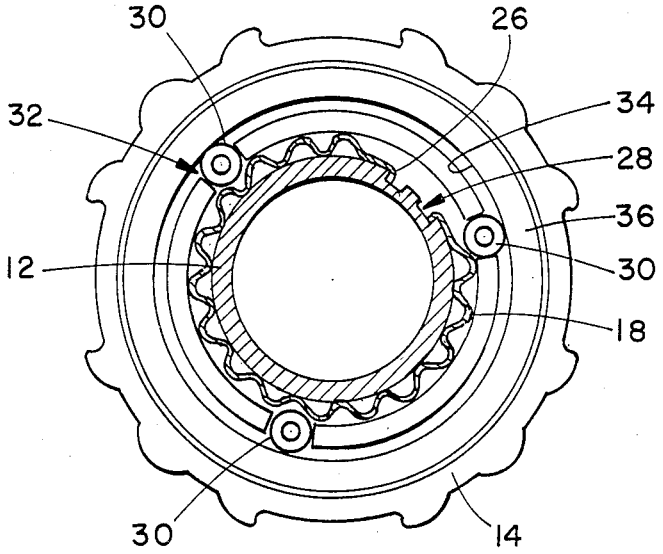
FIG. 3 is an axial cross-sectional view taken perpendicular to the axis of the assembly as illustrated in FIG. 2.

The ratchet mechanism of the present invention includes an elongated ratchet strip 18, as shown in FIGS. 1–3. The ratchet strip 18 bears a plurality of ratchet teeth 20.

As illustrated in FIG. 3, the ratchet teeth 20 are of general triangular configuration. As such, rotation relative to the ratchet strip, when it is engaged by a tooth engaging member, is approximately equally resisted in either direction. It is important to note, however, that the ratchet teeth need not be triangular in configuration. Rather, they can be made in a sawtooth configuration, or some similar configuration, wherein the inclines of opposite sides of each tooth are not equal, and the resistance of the ratchet strip, when its teeth are engaged by another member, is not equal in each direction. Tests have shown that it is preferable in some instances that the ratchet used for preventing inadvertent decoupling between screw thread connected parts resist rotation in the coupling direction less than rotation in a direction which causes decoupling or uncoupling.

The ratchet strip 18 is disposed about the outer circumference of the plug member 12. Its length is approximately equal to the circumference of the plug member 12. In a preferred embodiment, the ratchet strip is made of spring tempered 17-7 stainless steel and has a thickness of about 0.005". In this embodiment, the ratchet strip is approximately 0.110–0.120" in width. The ratchet teeth have a maximum height of about 0.015 to 0.018".

An advantage of use of the ratchet strip component to define the ratchet teeth is that the ratchet strip can be pre-made in long segments, i.e., much longer than the circumference of the plug member, from an elongated strip of stainless steel and an elongated die for impressing the ratchet teeth in the strip in long segments prior to assembly or the strip as a component of the connector. Portions of ratchet strip material can be precut to whatever length is desired to circumscribe the circumference of the plug member, irrespective of the plug member circumference in the particular application for which use is desired.

Additionally, the use of a separate ratchet strip to accommodate the ratchet teeth facilitates the embodiment of the ratchet teeth in material such as called for in this embodiment which is hard, smooth, durable and long wearing, irrespective of the material from which the electrical connector parts are made. Electrical connector parts are often made from materials such as aluminum, or composite plastic materials, which, while being useful and having some advantages for some purposes, do not lend themselves particularly well as making up components of ratchet mechanisms.

The stainless steel used for ratchet strip and ratchet teeth, as called for here, is advantageously hard and very smooth, so that it inhibits the formation of wear patterns, such as scratches and the like, which, after many connect/disconnect cycles, form the precursors to breakdown of the ratchet mechanism with subsequent wear.

Alternately, the ratchet strip can comprise a beryllium/copper alloy, but, where such an alloy is used, plating is often desirable to inhibit corrosion.

The ratchet strip is attached to the outer circumference of the plug member, and thus be substantially self-retaining, by the use of bent end portions which form tabs or ears 26 which engage surfaces of slots 28 in the plug body, as shown for example in FIG. 1.

A plurality of ratchet pins 30 are provided for abutting and engaging the teeth 20 of the ratchet strip 18. See FIGS. 1 and 3. In the preferred embodiment, the ratchet pins are three i- number distributed at 120° intervals about a circle concentric with the coupling nut axis. Each ratchet pin is a generally cylindrical piece of hardened stainless steel machined to a smooth finish and designed for smooth, durable long lasting engagement with the teeth 20 of the ratchet strip 18. Each ratchet pin is approximately 0.062 inches in diameter and approximately 0.105 to 0.115 inches in length.

Each of the ratchet pins 30 is located within a ratchet pin seating slot 32. Each ratchet pin seating slot 32 is sized such that its corresponding ratchet pin can be seated loosely therein, with a certain small degree of play.

As shown most clearly in FIG. 3, each of the ratchet pin seating slots 32 is provided as a recess defined by an inner wall 34 --f the coupling nut 14. Each ratchet pin seating slot extends radially all the way through the inner wall 3., but the actual perforation of the slot 32 through the wall 34 axially is not so long as to allow the ratchet pin 32 to escape through the opening thus created. The ratchet pin 32 thus "floats" in its associated ratchet pin seating slot 32.

Each ratchet pin is held with its axis substantially parallel to the axes of both the coupling nut and the plug body. Each ratchet pin is prevented from any substantial motion radially with respect to the coupling nut by the impingement between the ratchet pins and the ratchet strip, since the coupling nut is permanently, though loosely, engaged on the plug body. Axial movement of the ratchet pins is limited by the shoulder 15, and by coupling nut washer and cover structure 40 described below A ratchet retaining ring 36, seated in a groove on the inside of the coupling nut 14, engages the radially outer edges of the ratchet pins 30 and provides a substantially resilient force urging the ratchet pins inwardly in a radial direction against the exterior surface of the ratchet strip 18 and its ratchet teeth 20. The ratchet retaining ring 36 is a stainless steel, spring tempered, spiral wound ring, sized to impinge upon and urge the ratchet pins inwardly when the ratchet retaining ring is disposed around the pins. The strip 18 and the ring 36 are concentric with one another and coaxial with the plug.

The amount of force which the ratchet retaining ring should apply is at the present time best determined on an empirical basis, in accordance with the other mechanical parameters of the electrical coupling and ratchet mechanism being employed. When it is desired to increase the force applied by the ratchet retaining ring, a ratchet retaining ring of increased thickness is selected. Conversely, a thinner ratchet retaining ring will exert less force. Sometimes it is desirable to adjust the force applied as a function of the radial spacing of the ratchet pins from the coupling nut axis. This can be done by appropriate selection of the inner diameter of the ratchet retaining ring. Reducing the inner diameter of the ratchet retaining ring causes it to begin exerting resilient force on the ratchet pins 30 more quickly, as a function of ratchet pin separation, which in turn is a function of the circumferential position of the ratchet pins with respect to the ratchet teeth.

Referring again to FIG. 1, the electrical coupling apparatus further includes a washer/cover portion 40 and a coupling nut retaining ring 42, both of which are utilized in ways understood by the artisan of ordinary skill to partially close the cavity defined by the coupling nut.

The washer/cover 40 also keeps the ratchet pins from axial motion to the right as shown in FIG. 1.

The ratchet mechanism novel to this electrical connector apparatus includes the ratchet strip 18 with its associated teeth 20, the ratchet pins 30 seated in their associated ratchet pin seating slots 32, and the ratchet retaining ring 36 which, in cooperation with the coupling nut, maintains the ratchet strip, teeth and pins together in a functioning ratcheting arrangement.

Tests have shown that ratchet apparatus made in accordance with this invention can withstand thousands of couple/uncouple cycles without beginning to show appreciable wear patterns. The parts of the ratchet apparatus are made of materials which are optimized for the ratcheting function per se, and need not be the same or similar to the materials from which the body portions of the plug 12, coupling nut 14, or other major portions of the electrical connector apparatus are made. The ratchet apparatus is virtually universal in application, inasmuch as it can be used for electrical connectors of widely varying sizes and materials. Moreover, parts of the ratchet apparatus, such as the ratchet strip and its associated pins, can be substantially identical in construction for all applications.

Although the preferred embodiment is described here as being applied in connection with an electrical connector having a threaded coupling means, it should be appreciated that the ratchet apparatus of the present invention is not limited to use with connectors having portions which are couplable by the use of threads. Such a ratchet apparatus can have beneficial application in securing and stabilizing coupling between members having a threaded coupling feature, and/or between members couplable together by means other than threading, such as by bayonet coupling.

It will be understood that the description of the present invention is intended as illustrative, rather than exhaustive, of the invention. Those of ordinary skill in the relevant art may be able to make certain additions or modifications to, or deletions from, the specific embodiment disclosed herein, without departing from the spirit or the scope of the invention, as defined in the appended claims.

I claim:

1. An electrical connector comprising:

(a) interconnectable plug and receptacle mechanisms for carrying coactable electrical contact sets for interconnecting pairs of electrical cables;

(b) the mechanisms including coactable structure for selectively securing the mechanisms in interconnected relationship;

(c) a disconnection inhibiting structure interposed between the mechanisms for inhibiting disconnecting relative movement of the mechanisms, the structure including an elongated corrugated ratchet strip of resilient material and at least one coacting ratchet element;

(d) one of the mechanisms including at least one strip engagement surface coactable with the strip for maintaining the strip and the one mechanism in substantially constant relative circumferential relationship; and, (e) the other of the mechanisms including at least one element engagement surface for maintaining the other mechanism and the element in substantially constant relative circumferential relationship;

(f) whereby on relative movement of the mechanisms the element will be caused to index selectively from coaction with one strip corrugation to coaction with another corrugation and thus to another.

2. The connector of claim 1 wherein said at least one element is a cylindrical pin.

3. The connector of claim 1 wherein the one mechanism includes two strip engagement surfaces.

4. The connector of claim 1 wherein the receptacle mechanism includes a coupling nut.

5. The connector of claim 1 wherein the coactable structure comprises coactable threads.

6. The connector of claim 1 wherein there are a plurality of elements and the other mechanism includes a plurality of sets of element engagement surfaces.

7. The connector of claim 6 wherein the elements are circumferentially spaced.

8. An electrical connector assembly comprising:

(a) a generally cylindrical plug;

(b) a generally cylinder receptacle;

(c) a coupling nut attached generally coaxially to said plug but being axially rotatable with respect to said plug;

(d) threads borne by each of said coupling nut and receptacle for facilitating threaded coupling and uncoupling of said plug and said receptacle;

(e) an elongated ratchet strip bearing ratchet teeth, said ratchet strip being flexible for application about the outer circumference of said plug;

(f) a plurality of ratchet pins held by aid coupling nut for engagement with said ratchet teeth, and (g) a ratchet retaining ring carried by said coupling nut and being generally disposed coaxially with said nut and radially outside said ratchet pins for impingement upon and application of resilient biasing force against each of said ratchet pins in a substantially inwardly radial direction with respect to the axis of said coupling nut whereby the maintain the pins in contact with the strip.

9. The assembly of claim 8, wherein said ratchet strip comprises:

a thin elongated piece of stainless steel having said ratchet teeth formed therein.

10. The assembly of claim 8, wherein said ratchet retaining ring comprises:

a spiral wound stainless steel ring.

11. The assembly of claim 8, wherein each said ratchet pin comprises:

a relatively hard steel pin having a generally cylindrical configuration, and said coupling nut comprises means for holding said ratchet pins with their axes substantially parallel to the axis defined by said receptacle.

12. The apparatus of claim 8, wherein:

said ratchet strip comprises a relatively thin flexible piece of stainless steel having a hard smooth finish.

13. The connector of claim 8 wherein the strip and the plug have coactable, relative rotation inhibiting surfaces.

14. The connector of claim 13 wherein the coactable surfaces of the strip are provided by tab portions formed in the strip by binding end portions along bends which extend axially when the connector is in use.

15. A method of making a ratchet structure for inhibiting the inadvertent decoupling of plug and receptacle members, the plug and receptacle defining generally cylindrical configuration, said method comprising the steps of:

(a) making a ratchet strip by forming the strip with a die to define a series of ratchet teeth on a surface of the strip;

(b) wrapping the strip about at least a portion of the circumference of the plug;

(c) mounting ratchet pins within a coupling nut for engagement with the ratchet teeth of the ratchet strip when the plug and nut are engaged, and (d) operatively connecting a resilient means to the ratchet pins for resiliently applying a radially inward biasing force to the ratchet pins to maintain resilient impingement of the ratchet pins against the ratchet teeth when the plug and receptacle are engaged, and (e) mounting the coupling nut on the plug to facilitate engagement of the ratchet teeth with the pins.

16. The method of claim 15 further including the step of bending end portions of the strip to form a pair of rotation inhibiting tabs and wherein the tabs are each positioned near a respective one of a pair of coactable surfaces of the plug during the wrapping step.

17. An electrical connector comprising:

(a) interconnectable plug and receptacle mechanisms for carrying coactable electrical contact sets for interconnecting pairs of electrical cables;

(b) the plug mechanism including a coupling nut element rotatably carried by a plug member for threaded interconnection with the receptacle mechanism;

(c) one of the mechanisms including a spaced pair of rotation inhibiting surfaces;

(d) a ratchet assembly carried by and interposed between the mechanisms for inhibiting unintended mechanism disconnection, the assembly comprising:

(i) a corrugated strip member of relatively stiff material and having a spaced pair of tab portions formed near its ends, the strip member being bent into a substantially circular configuration and the end portions being respectively positioned near the rotation inhibiting surfaces, the end portions and the inhibiting surfaces being coactable to provide a substantially constant relative circumferential relationship between the strip member and said one mechanism;

(ii) a plurality of corrugation engaging members in ratcheting engagement with the strip member;

(iii) a resilient member in biasing engagement with the engaging members to maintain the engaging members in engagement with the strip member; and (iv) the strip and resilient members being substantially coaxial;

(e) the mechanisms including structure for inhibiting relative axial movement of the members whereby to maintain member engagement; and, (f) the mechanisms when the interconnected being coaxial with said assembly.

18. The apparatus of claim 17, wherein:

said strip element comprises a piece of thin stainless steel and wherein said teeth are defined by elevations in the surface of said thin stainless steel.

19. The connector of claim 17 wherein the engaging members are cylindrical pins.

20. The connector of claim 17 wherein the resilient member is a ring.

21. The connector of claim 20 wherein the ring is circumferentially disposed about the strip and the engaging members.

* * * * *